United States Patent [19]

Munch

[11] 4,214,349

[45] Jul. 29, 1980

[54] TIE WRAP

[75] Inventor: Emil L. Munch, Cincinnati, Ohio

[73] Assignee: Midland-Ross Corporation, Cleveland, Ohio

[21] Appl. No.: 965,106

[22] Filed: Nov. 30, 1978

[51] Int. Cl.[2] ..... B65D 63/00

[52] U.S. Cl. ..... 24/16 PB; 248/74 PB

[58] Field of Search ..... 24/16 PB, 17 AP, 73 PF, 24/73 PB; 248/74 PB

[56] References Cited

U.S. PATENT DOCUMENTS

| | | | |
|---|---|---|---|
| 3,049,771 | 8/1962 | Litwin et al. | 24/73 PB X |
| 3,402,435 | 9/1968 | Merser | 24/73 PB X |
| 3,416,198 | 12/1968 | Geisinger | 24/16 PB |
| 3,489,076 | 1/1970 | Countryman | 24/16 PB |
| 3,597,803 | 8/1971 | Van Neil | 24/16 PB |
| 3,712,655 | 1/1973 | Fuehrer | 24/16 PB |
| 3,944,269 | 3/1976 | Lundberg | 24/16 PB |
| 4,149,298 | 4/1979 | Forest | 248/74 PB X |

FOREIGN PATENT DOCUMENTS

| | | | |
|---|---|---|---|
| 1231614 | 12/1966 | Fed. Rep. of Germany | 24/16 PB |
| 1332239 | 6/1963 | France | 24/16 PB |
| 2361563 | 3/1978 | France | 24/16 PB |
| 2322286 | 3/1977 | France | 24/16 PB |

*Primary Examiner*—J. Franklin Foss

*Attorney, Agent, or Firm*—H. Duane Switzer

[57] ABSTRACT

A tie wrap includes a toothed strap extending from a head having a strap receiving passage with a pawl for cooperating with the strap teeth to prevent withdrawal of the strap from the passage when the strap is inserted through the passage in one direction. False latching of the tie wrap is precluded by an abutment adjacent the free end of the strap which cooperates with the pawl to prevent insertion of the strap through the passage in a direction opposite to the one direction.

6 Claims, 8 Drawing Figures

TIE WRAP

BACKGROUND OF THE INVENTION

This application pertains to the art of tie wraps and, more particularly, to tie wraps of the type including an elongated toothed strap extending from a head having a passage through which the strap is receivable. The invention is particularly applicable to tie wraps which cannot be released after the strap is extended through the head. However, it will be appreciated that certain features of the invention have broader aspects and can be used on tie wraps of other types.

Nonreleasable tie wraps are commonly used for security purposes because it is necessary to break the tie wrap in order to free the items held thereby and this provides a ready indication as to whether or not the held devices have been tampered with. For example, it is common to use tie wraps of this type for holding lids on containers. The tie wrap passes through aligned holes on the lid and container, and the tie wrap must be broken for allowing opening of the lid. Tie wraps of the type described are commonly constructed with one or more pawls positioned in a strap receiving passage in a head from which a toothed strap extends. Insertion of the strap through the head passage in one direction provides locking cooperation between the pawls and teeth for preventing retraction of the strap. Therefore, it is necessary to break the strap in order to release same. In tie wraps of this type, the strap can be inserted through the head passage in an opposite incorrect direction and the pawls will loosely grip the teeth for retaining the strap in its position extending through the head passage. However, there is no locking cooperation between the pawls and teeth, and withdrawal of the strap is readily accomplished simply by pulling on same. It would be desirable to have an arrangement for preventing inadvertent or intentional false latching of a strap through a head passage by preventing insertion of the strap through the head passage in an improper direction.

SUMMARY OF THE INVENTION

A tie wrap includes a toothed strap extending from a head having a strap receiving passage with a pawl for cooperating with the strap teeth to prevent withdrawal of the strap from the passage when the strap is inserted through the passage in one direction. The strap is normally insertable through the passage in a reverse direction but lacks cooperation between the pawl and teeth to prevent withdrawal thereof when so inserted. Cooperating means is provided between the head and strap for preventing insertion of the strap through the passage in the reverse direction.

In one arrangement, the cooperating means between the head and strap for preventing insertion of the strap through the passage in the improper reverse direction is in the form of at least one abutment adjacent the free end of the strap. The abutment cooperates with the end of the pawl in the passage for preventing movement of the abutment and passage past the pawl.

The strap preferably has a weakened frangible section adjacent the head to facilitate removal of the strap when so desired.

It is a principal object of the present invention to provide an improved tie wrap which cannot be false latched by assembling same in a reverse direction.

It is a further object of the invention to provide an improved tie wrap having a plurality of individual pawls cooperable with a plurality of individual teeth on a tie wrap strap.

It is also an object of the present invention to provide an improved tie wrap which is very economical to manufacture and simple to assemble.

It is an additional object of the invention to provide an improved tie wrap which can be used as a security tie, or can be used for other general purposes.

DESCRIPTION OF A PREFERRED EMBODIMENT

Figure 1:
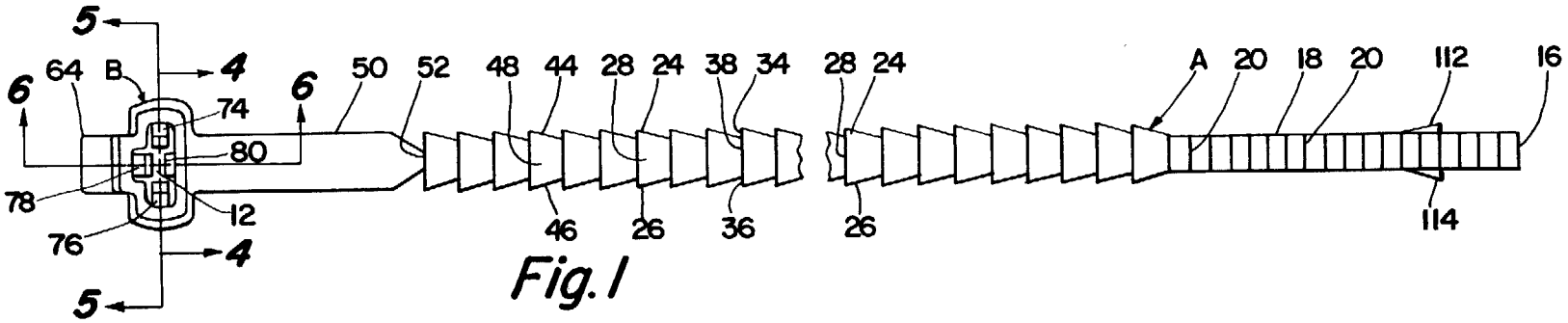
FIG. 1 is a bottom plan view of a tie wrap constructed in accordance with the present application.

With reference to the drawing, FIG. 1 shows a tie wrap molded in one-piece of flexible synthetic plastic material. The tie wrap includes an elongated flexible strap A extending from an enlarged head B having a strap receiving passage 12 therethrough.

Strap A has a free end 16 remote from enlarged head B and includes a free end portion 18 of smaller width and thickness than the remainder of strap A. A plurality of small spaced-apart teeth 20 are provided on one surface of free end portion 18 for providing a firm grip of end portion 18 between a person's thumb and finger.

Elongated flexible strap A is generally flat and of generally rectangular cross-sectional configuration. The opposite longitudinal sides of strap A are provided with a plurality of spaced-apart opposite side teeth 24 and 26. One face of strap A is provided with face teeth 28 aligned with side teeth 24 and 26. The face of strap A opposite from face teeth 28 is substantially smooth as indicated at 30.

Teeth 24, 26 and 28 have aligned shoulders 34, 36 and 38 extending substantially perpendicular to the longitudinal axis of strap A and facing toward enlarged head B. Teeth 24, 26 and 28 have sloping cam surfaces 44, 46 and 48 which are sloped relative to the longitudinal axis of strap A at included angles of approximately 15 degrees. Thus, tooth cam surfaces 44, 46 and 48 intersect shoulders 34, 36 and 38 at external corners having included angles of approximately 75 degrees.

The toothed portion of strap A is connected to a relatively short smooth strap portion 50 adjacent enlarged head B by a weakened frangible section 52 which is weaker and of smaller cross-sectional size than any other portion of strap A. This makes it very easy to break strap A from strap portion 50 and enlarged head B by twisting, bending and pulling to break frangible section 52.

Enlarged head B has an entrance end 60 and an exit end 62, and strap A is integrally connected thereto adjacent exit end 62. A rigid tab 64 extends outwardly from head B opposite from strap A. Tab 64 is thicker than strap A and aids in holding head B when inserting strap A through passage 12. Head B can be grasped between the thumb and middle finger while the index finger is placed against tab 64 to hold head B during insertion of strap A through strap receiving passage 12. Once end portion 18 of strap A is extended through passage 12 from entrance end 60 to extend outwardly of exit end 62, end portion 18 can be grasped for pulling the strap further through head B.

Passage 12 in head B has opposite side pawls 74 and 76 for cooperating with shoulders 34 and 36 on side teeth 24 and 26. A face pawl 78 in passage 12 is provided for cooperation with shoulders 38 on teeth 28. A rigid projection 80 is provided in passage 12 opposite face pawl 78 for engaging smooth face 30 of strap A to hold strap A with face teeth 28 engaging face pawl 78.

Figure 4:
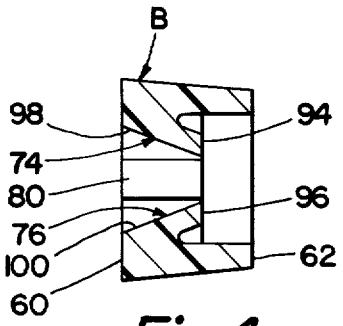
FIG. 4 is a cross-sectional elevational view taken generally on line 4—4 of FIG. 1.
Figure 5:
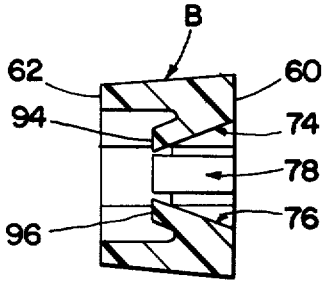
FIG. 5 is a cross-sectional elevational view taken generally on line 5—5 of FIG. 1.

As shown in FIG. 4, side pawls 74 and 76 extend in a direction from head entrance end 60 toward head exit end 62. Side pawls 74 and 76 also extend inwardly toward the longitudinal axis of the passage through head B, and terminate at side pawl ends 94, 96 extending substantially perpendicular to the longitudinal axis of the strap receiving passage through head B. Side pawl ends 94, 96 are spaced from exit end 62 and intersect side pawl cam surfaces 98, 100 which slope inwardly toward the longitudinal axis of the strap receiving passage from head entrance end 60. Pawls 74, 76 are yieldable generally radially outwardly of the longitudinal axis of the strap receiving passage through head B.

Figure 6:
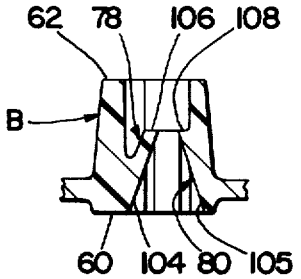
FIG. 6 is a cross-sectional elevational view taken generally on line 6—6 of FIG. 1.

As shown in FIG. 6, face pawl 78 and rigid projection 80 have cam surfaces 104, 105 which slope toward the longitudinal axis of the strap receiving passage through head B from head entrance end 60. Face pawl 78 and rigid protection 80 have ends 106, 108. Face pawl 78 is yieldable generally radially of the longitudinal axis of the strap receiving passage through head B. The distance across the ends of side pawls 74, 76 is approximately the same as the distance across the narrowest parts of side teeth 24, 26 adjacent side shoulders 34, 36. Likewise, the distance across the ends of face pawl 78 and rigid projection 108 is approximately the same as the distance across the opposite faces of strap A at the narrowest portions of face teeth 28.

End portion 18 of strap A is provided with abutment means in the form of opposite abutments 112, 114 having abutment surfaces 116, 118 extending perpendicular to the longitudinal axis of strap A and facing toward free end 16 thereof. Projections 112, 114 have cam surfaces 120, 122 of approximately equal but opposite slope to tooth cam surfaces 44, 46 and 48.

Figure 2:
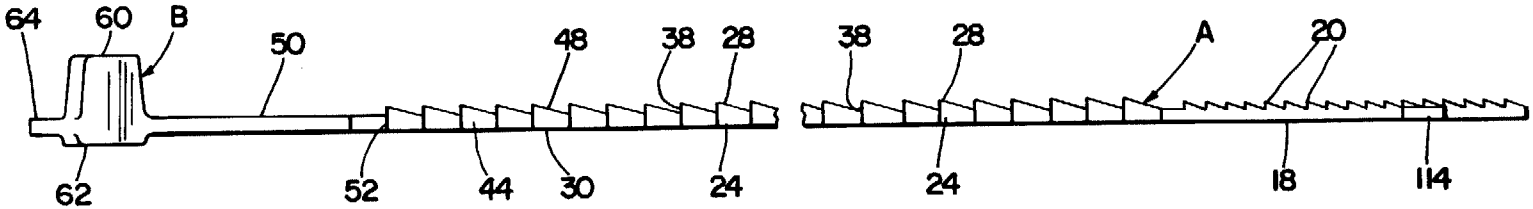
FIG. 2 is a side elevational view of the tie wrap of FIG. 1.
Figure 3:
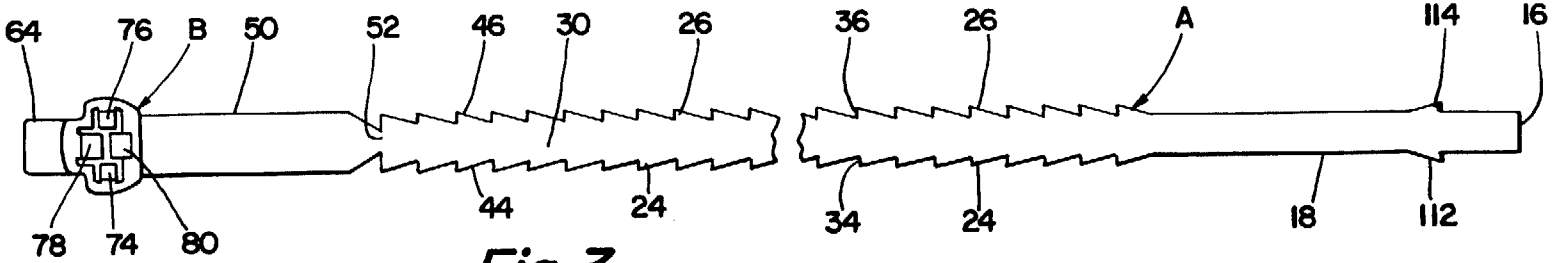
FIG. 3 is a top plan view of the tie wrap of FIGS. 1 and 2.
Figure 8:
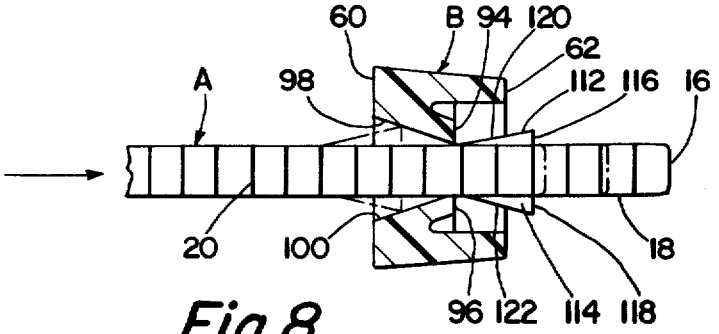
FIG. 8 is a view similar to FIG. 7 and showing insertion of a strap through a head passage in a proper direction.

The tie wrap is placed in use by bending strap A upwardly in FIG. 2 for inserting free end 16 thereof through the passage in head B from entrance end 60 toward exit end 62. As shown in FIG. 8, abutment surfaces 116, 118 on abutments 112, 114 simply strike against side pawl cam surfaces 98, 100 to deflect pawls 74, 76 generally radially outwardly for allowing passage of the abutments. Once strap end portion 18 is extending beyond head exit end 62, the strap end portion may be grasped for pulling the strap further through head B. The cam surfaces on the teeth are of approximately equal slope with the pawl cam surfaces and cooperate therewith to simply slide therepast when strap A is pulled in the direction of arrow 130 in FIG. 8 relative to head B. Any attempt to pull strap A through head B in a direction opposite to direction 130 is prevented by engagement between the pawl ends and the tooth shoulders. Thus, side tooth shoulders 34, 36 will engage pawl ends 94, 96, while face pawl shoulders 38 will engage face pawl end 106. The plurality of individual pawls, along with their recessed location from head exit end 62, makes it extremely difficult if not impossible to release the pawls for freeing the strap for reverse movement.

Figure 7:
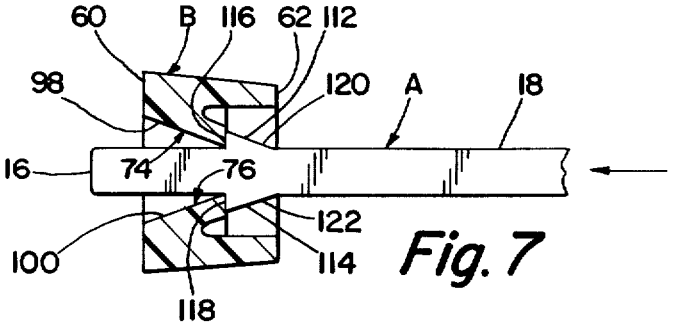
FIG. 7 is a cross-sectional view similar to FIG. 4 and showing an attempt to insert a strap through a head passage in an improper direction.

In devices of the type described, it is normally possible to insert the strap through the head passage in a reverse direction. This is because the cam surfaces on the teeth will cooperate with the blunt ends of the pawls with sufficient cam action to move the pawls outwardly for allowing movement of the strap therepast. However, the pawls loosely retain the strap in an inserted position through the head and it is not possible to immediately determine that the strap is incorrectly inserted. In order to prevent such false latching and incorrect insertion, abutments 112, 114 operate in the manner shown in FIG. 7 by having abutment surfaces 116, 118 strike against the ends of pawls 74, 76 to prevent incorrect insertion of strap A through the strap receiving passage.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A tie comprising: a head having an elongated flexible strap integrally formed therewith, a passage through said head extending substantially perpendicular to said strap for longitudinally receiving said strap, said passage having an entrance end and an exit end, said strap having a plurality of longitudinally-spaced teeth thereon and terminating at a free end, said teeth having shoulders facing toward said head and having teeth cam surfaces facing toward said free end, said shoulders and cam surfaces on each tooth meeting at intersections, at least one pawl in said passage for cooperating with said teeth, said pawl extending in a direction from said entrance end of said passage toward said exit end thereof, said pawl having a pawl cam surface facing toward said entrance end of said passage and a pawl terminal end facing toward said exit end of said passage, said pawl projecting generally radially into said passage to restrict the opening therethrough to a size less than the size of said strap across said intersections, said pawl being movable generally radially outwardly for movement of said teeth intersections therepast when said strap is extended through said passage, said strap being insertable through said entrance end of said passage by cooperation between said teeth cam surfaces and said pawl cam surface to cam said pawl generally radially outwardly for movement of said teeth shoulders past said pawl terminal end for providing cooperation between said shoulders and said pawl terminal end to prevent reverse movement of said strap out of said passage, said pawl terminal end being spaced a substantial distance from said passage exit end such that said pawl is not accessible through said exit end for releasing same from engagement with said shoulders, said teeth cam surfaces being shaped for normally cooperating with said pawl terminal end to bias same outwardly and provide insertion of said strap through said passage in a direction from said exit end toward said entrance end, and abutment means on said strap adjacent said free end thereof for engaging said pawl terminal end to prevent insertion of said strap through said exit end of said passage, said abutment means being freely movable past said pawl when said strap is inserted into said passage through said entrance end thereof.

2. The tie wrap of claim 1 wherein said strap is generally flat and has opposite faces and opposite sides, and said abutment means comprises an opposite pair of enlargements on said opposite sides, said enlargements having abutment surfaces facing toward said free end of said strap and having abutment cam surfaces facing toward said head.

3. The tie wrap of claim 1 wherein said strap has a weakened frangible section adjacent said head.

4. The tie wrap of claim 1 wherein said strap is substantially flat and has opposite faces and opposite sides, said teeth being provided on one of said faces and on both of said sides, and said passage having opposed pawls cooperable with said teeth along said sides and a central face pawl cooperable with said teeth along said face.

5. The tie wrap of claim 4 wherein the other of said faces opposite from said one face having said teeth thereon is substantially smooth, and said head having a projection extending into said passage opposite from said face pawl for engaging said other face to maintain said teeth on said one face in engagement with said face pawl.

6. The tie wrap of claim 1 including a rigid tab extending outwardly of said head opposite from said strap for aiding in holding said head during insertion of said strap through said passage.

* * * * *